United States Patent [19]

Stuckman

[11] Patent Number: 4,627,183

[45] Date of Patent: Dec. 9, 1986

[54] FIREARM WITH AIMING LIGHT

[76] Inventor: Lowell R. Stuckman, 1315 Cuatro Cerros Tr. SE., Albuquerque, N. Mex. 87123

[21] Appl. No.: 721,946

[22] Filed: Apr. 11, 1985

[51] Int. Cl.[4] ..... F41G 1/34

[52] U.S. Cl. ..... 42/1.01; 362/110; 362/114

[58] Field of Search ..... 362/110–114; 42/1 A, 1 S

[56] References Cited

U.S. PATENT DOCUMENTS 2,718,724 9/1955 Teague ..... 42/1 A
3,488,488 1/1970 Crouch ..... 362/110
3,513,581 5/1970 Slater ..... 42/1 A
4,212,109 7/1980 Snyder ..... 362/110

*Primary Examiner*—William A. Cuchlinski, Jr.
*Attorney, Agent, or Firm*—H. Mathews Garland

[57] ABSTRACT

A firearm having an aiming light secured along the barrel at a position to project a light beam in intersecting relationship with the barrel to cast an aiming shadow from the discharge end portion of the barrel on a lighted target area at the point of impact of the shot pattern of the gun. The aiming light includes a narrow beam focusing lens bulb, a battery, a battery retaining spring and switch member, and an actuating button for operating the spring switch housed in a chamber of the stock of the gun.

13 Claims, 7 Drawing Figures

FIREARM WITH AIMING LIGHT

This invention relates to firearms and more particularly relates to firearms for use under low level light conditions.

Business and home security is more and more threatened by unauthorized entry of persons seeking to steal property and often do bodily harm. Frequently such attacks come when light conditions range from a very low level to complete darkness. When they occur during darkness, defensive efforts are very difficult because of the problem of being able to see the the threatening person or persons. It becomes especially difficult under very dark conditions to operate firearms because of inability to use the sights on the firearms. Thus, a person firing a gun in essentially complete darkness, especially a very inexperienced person, runs an excellent chance of missing the target and also becomes an excellent target for return fire. There are no known devices especially useful with firearms for aiming them in the dark.

SUMMARY OF THE INVENTION

It is therefore a principal object of the invention to provide a new and improved firearm which may be aimed and fired at an intruder in complete darkness.

It is another object of the invention to provide a firearm with a built-in aiming light.

It is another object of the invention to provide a firearm having an aiming light which may be fired at a target without raising the firearm to a normal shoulder level aiming position before firing.

It is another object of the invention to provide a firearm with an aiming light which will light a target around the area of impact of the shot pattern at the target and an aiming shadow adjacent to the shot pattern for accurate shot placement.

It is another object of the invention to provide a firearm with an aiming light which may be turned on and off by the operator of the firearm at the time of firing.

It is another object of the invention to provide a firearm having an aiming light including a focusing lens bulb and battery fully inclosed within the stock of the firearm.

In accordance with the invention there is provided a firearm having a built-in aiming light secured along the barrel in a position to project a visible light beam along the barrel past the discharge end to light a target area around the point of impact of the shot pattern and cast an aiming shadow pointing to the shot pattern.

BRIEF DESCRIPTION OF THE DRAWING

The foregoing objects and advantages and a preferred embodiment of the firearm of the invention will be better understood from the following detailed description thereof taken in conjuntion with the accompaning drawings wherein.

DETAILED DESCRIPTION OF THE PREFERRED EMBODIMENT

Figure 1:
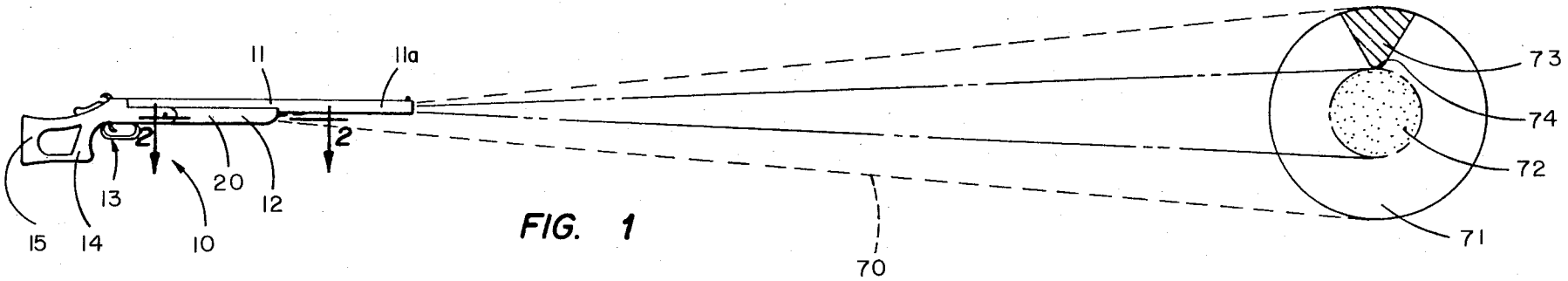
FIG. 1 is a side view in elevation of a shotgun constructed in accordance with the invention, schematically illustrating a lighted target area, the shot pattern at the point of impact of the gun, and an aiming shadow within the lighted area pointing at the shot pattern.

Referring to FIG. 1, a firearm embodying the features of the invention is a shotgun 10 which includes a barrel 11 mounted on a stock 12 and a trigger assembly 13. The stock has a grip 14 which especially adapts the gun for shooting from a number of different positions including, particularly, at the waist or hip level. The stock has a butt end portion 15 secured with the grip 14 which may rest against the shoulder. Though the gun may also be shot at the shoulder level, the stock is not as long as a normal gun designed for shooting from the shoulder. The gun 10 is a shotgun manufactured and sold under the trademark NIGHT CHARMER by Sporting Arms Inc., Dallas, Tex. The gun is designed for a number of uses including sport shooting in which it is shot with one hand holding the grip and the other the fore-end stock, and the user aiming down the barrel.

Figure 3:
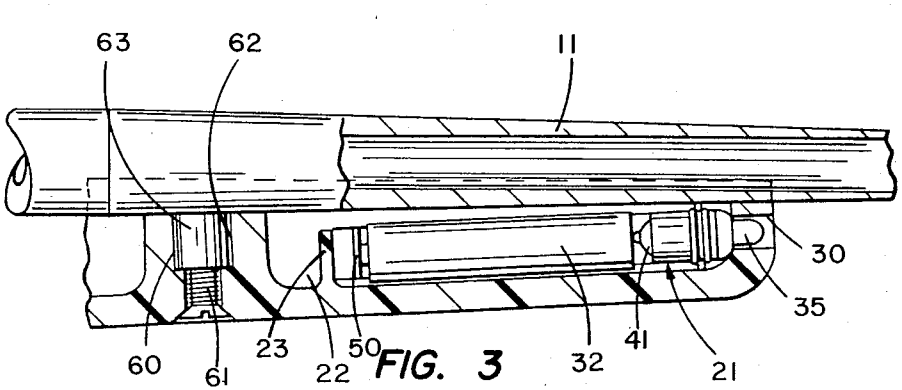
FIG. 3 is a longitudinal view in section and elevation along a vertical plane of the portion of the device of the invention shown in FIG. 2.
Figure 2:
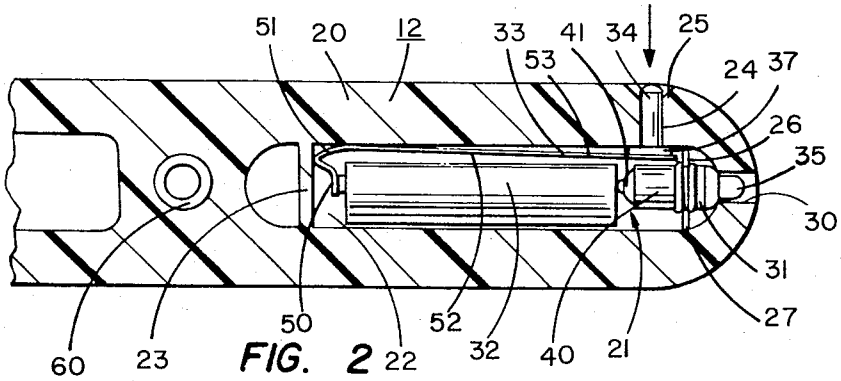
FIG. 2 is an enlarged fragmentary view in section and elevation showing the built-in aiming light system of the invention seen along the line 2—2 of FIG. 1.

The stock 12 has a removeable fore-end 20 extending along the bottom and toward the discharge end of the barrel 11. An aiming light assembly 21 is mounted in the fore-end of the stock beneath barrel. The fore-end of the stock has a longitudinal chamber 22 which opens through the top of the stock beneath the barrel as seen in FIG. 3. A transverse partial wall or partition 23 extends upwardly from the floor of the chamber 22 across the chamber near the rear end of the chamber to serve as a battery stop. As also seen in FIG. 3, the chamber 22 is formed along an axis sloping upwardly toward the axis of the gun barrel toward the discharge end of the barrel. As seen in FIG. 2, a lateral bore 24 opens through the fore-end of the stock into the forward end of the chamber 22. The outward end of the bore 24 is flared at 25 to provide a finger or thumb recess to actuate the aiming light. An axial bore 30 is provided through the forward end of the stock fore-end into the chamber 22 along the axis of the chamber for the light beam from the aiming light assembly. A pair of vertically extending laterally spaced retainer flanges 26 and 27 are formed in the chamber 22 forward of the bore 24 for retaining a light bulb of the assembly 21 in position.

The aiming light assembly 21 housed in the chamber 22 includes a bulb 31, a battery 32, a battery retainer and switch spring 33, and a light operator button 34.

The bulb 31 is preferably a narrow beam focusing lens bulb having a dome shaped focusing lens 35 which fits snugly within the bore 30. The bulb has a tubular body 40 fitted tightly between the retaining flanges 26 and 27. The bulb has a base contact end 41 providing electrical contact between the bulb and the forward end of the battery 32. The spring 33 holds the battery 32 snugly in the chamber 22 and functions both to conduct electrical energy from the battery to the bulb as well as performing a switching function for turning the bulb off and on. The spring 33 is a J-shaped member formed of spring steel having a contact end 50 engaging the rear end of the battery 32. The spring has a longitudinal body portion 51 provided with a dimple 52 which engages the side of the battery 32 holding the battery in place and the spring body away from the battery side so that a switch end portion 53 of the spring is biased outwardly away from the battery side between the inward end of the button 34 and the side of the body 40 of the bulb 31. In the normal off position of the switch end of the spring as shown in FIG. 2 the switch end 53 is spaced from the bulb body so that it does not electrically contact the bulb. The outer face of the spring switch end engages the inside inner end of the button 34 holding the button in an outward off position as shown in FIG. 2. The button 34 has an inward external annular end flange 37 which keeps the button from falling out of the bore 24. The battery 32 is preferably a 3.6 volt lithum battery having a normal ten year shelf life. The sizing and spacing of the battery 32, the spring 33, and the bulb 31 provides a tight fit of the battery within the chamber with the spring end 50 contacting the rear end of the battery urging the forward end of the battery against the bulb base contact 41. The side spacing provides a tight fit between the spring dimple 52 and the side of the battery holding the other side of the battery against the opposite wall of the chamber 22. The normal relaxed position of the switch spring holds the button 34 outward to the "off" position illustrated in FIG. 2.

The stock fore-end 20 has a vertical bore 60 for a screw 61 which holds the fore-end of the stock on the bottom of the barrel. An enlarged portion 62 of the bore 60 receives a lug 63 formed on the bottom of the barrel. The screw 61 threads into the lug 63 holding the fore-end 20 of the stock on the barrel. As apparent in FIG. 1, the fore-end 20 of the stock is a separate removeable portion to permit changing of the battery and bulb.

The gun stock may be molded of a suitable synthetic material or may be constructed of wood. As previously discussed, the chamber 22 is formed in the fore-end portion of the stock along an axis intersecting the axis of the barrel 11 so that the beam of light emitted by the bulb 31 is intercepted by the discharge end portion 11*a* of the barrel casting an aiming shadow in the light beam providing a visible pointer in the light beam directed at the shot pattern of the gun in the light pattern on the target. The co-action between the tapered round barrel of the gun and the light beam produces a substantially triangular shadow having a lower apex pointing to and substantially engaging the outer edge of the round shot pattern at the target impact point of the light beam from the gun.

The user of the gun 10 of the invention may fire the gun from a number of positions which may include a hip position to which a gun may be quickly raised. Sighting down the barrel of the gun in the normal manner is not required in low light conditions. The gun may be fired either right-handed or left-handed with a finger or thumb of the opposite hand engaging the operator button 34 to turn the aiming light "on" and "off". The button 34 is depressed moving the spring biased switch end 53 of the spring 33 inwardly engaging the side face of the body 40 of the bulb 31. Contact is provided by the spring from the rear end of the battery 32 into the bulb body the base contact end of which engages the forward end of the battery 32. Thus, a current flows from one end of the battery through the bulb back into the battery turning the bulb on so that the dome shaped focusing lens 35 in the bore 30 projects a light beam 70, FIG. 1, aimed upwardly in intersecting relationship with the gun barrel 11. The light beam strikes a target producing a lighted area 71 on the target which surrounds the shot pattern 72 on the target when the gun is fired. The discharge end 11*a* of the barrel 11 intercepts the light beam producing a triangular shaped aiming shadow 73 having a lower apex 74 pointing to and substantially engaging the shot pattern. The person firing the gun needs only to direct the beam of light from the aiming light to the desired target with the light pattern 71 striking the target and the aiming shadow 73 positioned near the point of impact desired for the shot pattern 72. It can be expected by the person firing the gun that the shots from the gun will strike the target immediately below the apex 74 of the aiming shadow. Thus, quick accurate results may be obtained by the user of the gun simply turning on the aiming light, moving the lighted area to the target with the apex of the aiming shadow pointed at the desired impact area of the target, and pulling the trigger of the gun. This entire firing procedure may be carried out in total darkness without the necessity for aiming the gun in a conventional manner, which, of course, would be impossible in total darkness. The relationship of the lighted area of the target 71, the shot pattern 72, and the aiming shadow 73 remains substantially constant at varying distances from the target. It will be apparent to those familiar with the type shotgun of the preferred embodiment that the gun is effective primarily at rather short ranges. Of course, in most instances of the gun being used for security purposes against persons attempting property damage and personal harm, the gun normally would be fired in close proximity to the offending person. Because it is only necessary to cast the beam of light with the aiming shadow on the desired target, only a fraction of a second is necessary to properly aim and fire the gun.

Figure 7:
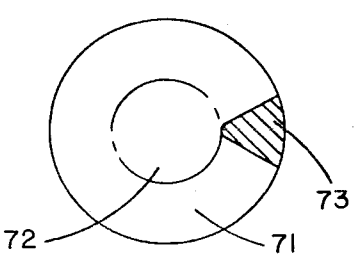
FIG. 7 is a schematic view of the lighted target area and the aiming shadow when the aiming light is mounted along the left side of the gun barrel as viewed from the discharge end in FIG. 4.
Figure 6:
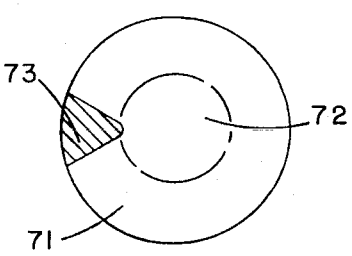
FIG. 6 is a schematic view, similar to FIG. 5, showing the lighted target area and aiming shadow when the light is along the right side of the gun barrel as viewed from the discharge end in FIG. 4.
Figure 5:
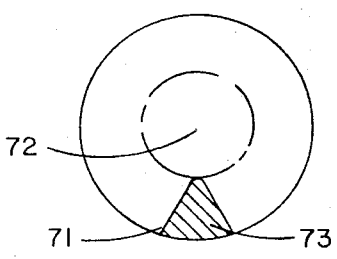
FIG. 5 is a schematic view of the lighted target area showing the position of the aiming shadow with the light mounted along the top of the gun barrel.
Figure 4:
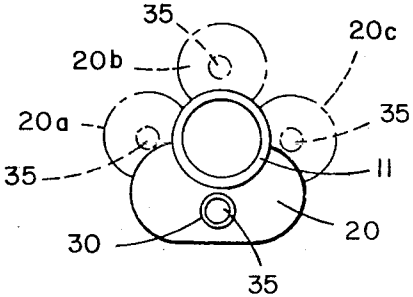
FIG. 4 is a front view in elevation of the firing end of the gun of FIGS. 1—3 illustrating schematically in phantom lines alternative positioning of the aiming light of the invention.

While the preferred form of the gun 10 has been described with the aiming light located below the barrel 11, it will be understood other positions of the aiming light will achieve the same result. Alternative positions of the stock portion 20 holding the aiming light system are illustrated in FIG. 4 which shows locations around the gun barrel for the aiming light assembly. Referring to FIGS. 4–7, a stock portion 20*a* may be secured on the left side of the barrel 11 facing the discharge end of the gun to produce the aiming shadows 73 on the opposite side of the target lighted area 71 as shown in FIG. 7. Placing the aiming light assembly in a stock portion 20*b* on the top of the barrel produces a aiming shadow beneath the shot pattern in the lighted area 71 as shown in FIG. 5. Positioning the stock portion 20*c* with the aiming light assembly on the right hand side of the barrel, as seen in FIG. 4, produces an aiming shadow 73 on the left hand side of the lighted area 71 pointing at the shot pattern as seen in FIG. 6.

The firearm 10 of the invention has been described in terms of the preferred embodiment which is a special short form of 410 gauge shotgun. It will be evident, however, that other forms of shotguns as well rifles and some handguns may be fitted with an aiming light emboding features of the invention. With the somewhat different shot pattern of other designs of guns some adjustments will be made in the positioning of the aiming light to insure that the aiming shadow points as nearly as possible to the point of impact of the shot pattern, whether a single bullet or shotgun pellets strike the area on the target lighted by the narrow beam focusing lens bulb.

What is claimed is:

1. A firearm including in combination a barrel having a discharge end, an aiming light assembly secured with said barrel to project a visible light beam along said barrel beyond said discharge end of said barrel in intersecting relationship with said barrel to impinge on and produce a lighted area on a target circumscribing an impact area of a shot pattern from said firearm on said target and to produce an aiming shadow from said discharge end of said barrel substantially triangular in shape and having an apex pointing at said shot pattern, and means for turning said light assembly "on" and "off".

2. A firearm in accordance with claim 1 where said barrel is mounted on a stock and said aiming light assembly is housed in a cavity in said stock and includes a switch operator button extending through an opening in said stock and engageable by a user of said firearm to turn said aiming light "on" and "off".

3. A firearm in accordance with claim 2 wherein said aiming light assembly includes a battery, a bulb, and a switch actuated by said switch operator button.

4. A firearm in accordance with claim 3 wherein said bulb is a narrow beam focusing lens bulb.

5. A firearm in accordance with claim 4 wherein said aiming light assembly is mounted below said barrel.

6. A firearm in accordance with claim 5 wherein said aiming light assembly is mounted along one side of said barrel.

7. A firearm in accordance with claim 4 wherein said aiming light assembly is mounted above said barrel.

8. A firearm in accordance with claim 1 wherein said aiming light assembly is mounted below said barrel positioned to project said light beam along an axis extending upwardly in intersecting relationship with the axis of said barrel.

9. A firearm in accordance with claim 8 wherein said stock has a fore-end portion secured along the bottom of said barrel and provided with a cavity defining an upwardly opening chamber closed at the top by a bottom surface of said barrel for housing said aiming light assembly, an opening through the forward end of said stock into said chamber for said light beam from said aiming light assembly, a lateral opening into said chamber, and an operator button through said lateral opening and coupled to said aiming light assembly in said chamber for turning said light assembly on and off.

10. A firearm in accordance with claim 9 wherein said aiming light assembly includes a battery, an operator button, a retainer and switch spring for holding a battery in position in said chamber and engageable by said button for turning said aiming light assembly "on" and "off".

11. A firearm in accordance with claim 10 wherein said chamber in said stock is formed along an axis sloping upwardly in intersecting relationship with the axis of said barrel.

12. A firearm comprising in combination: a barrel; a stock secured with said barrel including a removeable fore-end portion mounted below said barrel extending toward the discharge end of said barrel; said fore-end portion of said stock having a longitudnal chamber opening through the top of said stock portion and formed along an axis extending upwardly and in intersecting relationship with the axis of said barrel toward the discharge end of said barrel; a lateral opening in said stock opening into a forward end of said chamber an axial opening in said stock from the forward end of said stock into said chamber along the axis of said chamber; a focusing lens light bulb in said opening in said forward end of said stock; a spring member in said chamber for retaining a battery therein and selectively making contact between said battery and said bulb; an operator button in said transverse opening into said chamber of for operating said battery retainer spring to connect and disconnect said battery and said bulb for turning said bulb "on" and "off"; and said bulb being positioned to project a light beam in intersecting relationship with said discharge end of said barrel to light a target area and produce an aiming shadow from said barrel discharge end portion on said lighted area of said target, said aiming shadow being triangular in shape and having an apex pointing to the shot pattern on said target within said lighted area.

13. A firearm in accordance with claim 12 wherein said chamber includes a transverse wall member for holding one end of said battery and transversely spaced bulb retainer flanges for engaging the body of said bulb to hold said bulb in place and said spring is a J-shaped spring having a first hook-shaped end for engaging a positive pole on a battery, a substantially straight body portion having a dimple section therein for engaging a side of said battery to hold said body portion in spaced relation along said battery, and a switch end portion of said body portion held in spaced relation along the body of said bulb for engagement and disengagement with said bulb body responsive to movement of said operator button to turn said bulb "on" and "off".

* * * * *